US011546686B2

(12) United States Patent
Clark et al.

(10) Patent No.: US 11,546,686 B2
(45) Date of Patent: Jan. 3, 2023

(54) HEADPHONE EAR PAD SYSTEM

(71) Applicant: Dan Clark Audio, Inc., San Diego, CA (US)

(72) Inventors: Daniel William Clark, San Diego, CA (US); Robert Jason Egger, San Diego, CA (US)

(73) Assignee: DAN CLARK AUDIO, INC.

( * ) Notice: Subject to any disclaimer, the term of this patent is extended or adjusted under 35 U.S.C. 154(b) by 0 days.

(21) Appl. No.: 17/301,524

(22) Filed: Apr. 6, 2021

(65) Prior Publication Data

US 2022/0321990 A1 Oct. 6, 2022

(51) Int. Cl.

| | |
|---|---|
| ***H04R 25/00*** | (2006.01) |
| ***H04R 1/10*** | (2006.01) |
| ***H04R 31/00*** | (2006.01) |

(52) U.S. Cl.

CPC ..... *H04R 1/1058* (2013.01); *H04R 1/1008* (2013.01); *H04R 31/00* (2013.01)

(58) Field of Classification Search

CPC .. H04R 1/1083; H04R 1/1075; H04R 1/1008; H04R 1/2811

See application file for complete search history.

(56) References Cited

U.S. PATENT DOCUMENTS

| | | | | |
|---|---|---|---|---|
| 3,968,334 | A * | 7/1976 | Padilla | A61B 5/12 73/584 |
| 6,082,485 | A | 7/2000 | Smith | |
| 8,270,657 | B2 | 9/2012 | Takigawa | |
| 8,295,505 | B2 | 10/2012 | Weinans | |
| 9,703,123 | B2 | 7/2017 | Fonte | |
| 9,894,449 | B2 | 2/2018 | Kwon | |
| 10,045,113 | B2 | 8/2018 | Silvestri | |
| 10,560,792 | B2 | 2/2020 | Lin | |
| 2008/0273737 | A1* | 11/2008 | Oosato | H04R 1/1008 381/370 |
| 2011/0142276 | A1* | 6/2011 | Uchida | H04R 1/1075 381/370 |
| 2017/0173289 | A1* | 6/2017 | Lucey | A61M 16/0816 |
| 2018/0361096 | A1* | 12/2018 | Grashow | A61M 16/0694 |

FOREIGN PATENT DOCUMENTS

| | | | |
|---|---|---|---|
| CH | 659772 | * | 2/1987 |

* cited by examiner

*Primary Examiner* — Amir H Etesam
(74) *Attorney, Agent, or Firm* — Hall Estill Law Firm

(57) ABSTRACT

A headphone ear pad system may generate a custom ear pad from a three-dimensional data set of a user. The custom ear pad is attach to a headphone housing and is subsequently used to form an acoustic coupling with an ear of the user and an acoustic driver of the headphone housing. The custom ear pad can have a customized cross-sectional shape and sealing surface to create an optimized acoustic profile for the user.

20 Claims, 5 Drawing Sheets

HEADPHONE EAR PAD SYSTEM

SUMMARY

In some embodiments, a headphone ear pad system generates a custom ear pad from a three-dimensional data set of a user or generic designs manufactured using novel techniques and materials. The custom ear pad is attached to a headphone housing and is subsequently used to form an acoustic coupling with an ear of the user and an acoustic driver of the headphone housing. In some embodiments, an ear pad may be molded or cast using flexible, skin-safe materials, such as silicone or butyl rubber, to completely eliminate conventional foam cores from the ear pad. Various embodiments of a printed, or molded, ear pad contain embedded elements to shape the acoustic response of the headphone. The custom ear pad can have a customized cross-sectional shape and sealing surface to create an optimized acoustic profile for the user.

DETAILED DESCRIPTION

Various embodiments of this disclosure are generally directed to structure, methods of making, and methods of using a headphone ear pad.

Today's headphones use universal ear pads comprised of foam or foam wrapped in a sleeve of leather or other natural, or synthetic, fabric. It is noted that some ear pads can utilize gel or air cores alone, or in combination with foam, but neither material has achieved widespread adoption as they are prone to leakage and historically have been neither particularly reliable or comfortable. These generic, foam-based designs are mass produced, and are designed to fit a wide range of users. While foam-based ear pad designs are currently the most cost-effective ear pad solution for headphones and enjoy near universal application, these designs are limited in performance in several ways.

Figure 1A:
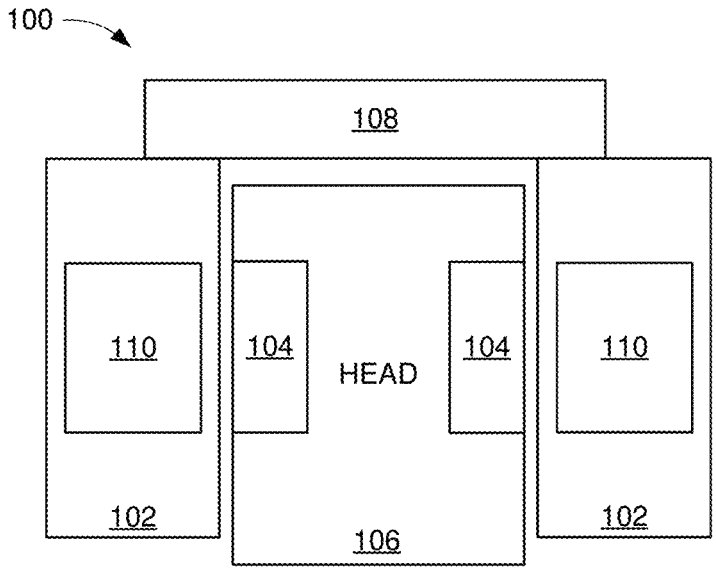
FIGS. 1A and 1B respectively convey representation of portions of an example headphone system in which various embodiments may be practiced.
Figure 1B:
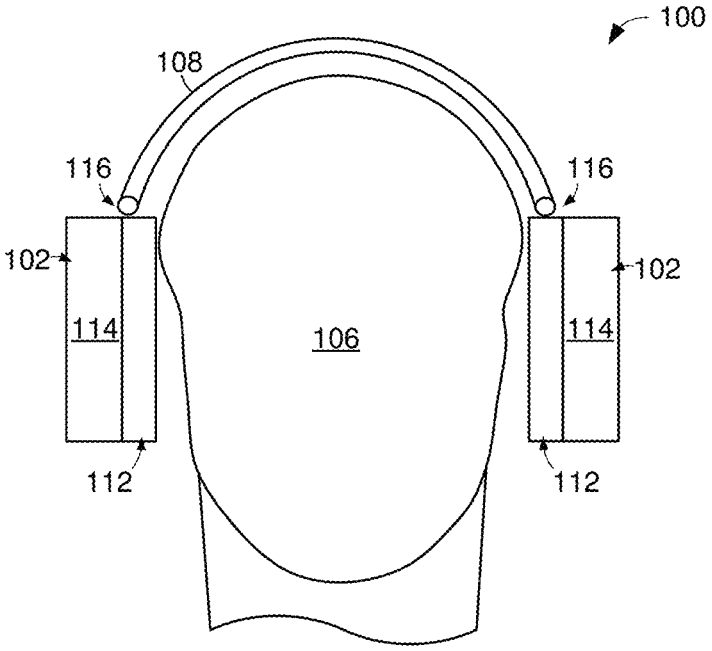

FIGS. 1A and 1B respectively depict block and line representations of portions of an example headphone system 100 arranged in accordance with some embodiments. The headphone system 100 shown in FIG. 1A has an ear cup 102 positioned proximal to an ear 104 of the head of a user 106 with a headband 108. The ear cup 102 can house one or more audio drivers 110, such as a dynamic, planar magnetic, or electrostatic arrangements, that converts electrical signals to sound waves experienced by the user 106.

The headphone system 100 may be configured with a single ear cup 102, but most embodiments present two ear cups 102 placed on opposite ends of the headband 108 to physically engage both ears 104 of the user 106. The headphone system 100 can have control, digital-to-analog (DAC), and amplification circuitry placed locally, such as in an ear cup 102, or remotely, such as in an attached cable or wirelessly connected audio source.

In general, the arrangement of ear cup(s) 102 about a user 106 via a headband 108 has had little emphasis on practical acoustics of the ear cup 102 and driver(s) 110, as generally illustrated in FIG. 1B. For instance, a headphone directed to fashion are made of materials that provide an aesthetic appeal without concern for comfort during use or providing proper ear cup 102 position for different head shapes. As another example, a headphone directed to comfort can result in inconsistent placement of the ear cups 102 with respect to the user 106 after the headband 108 is stretched and/or compressed during normal placement, and removal, from the user's head.

The comfort of a headphone can be altered with the addition of ear pads 112 that physically contact the user's head 106 proximal to an ear 104. The front view of FIG. 1B depicts how an ear cup assembly 102 can consist of an ear pad 112 attached to a headphone housing 114 so that the ear pad 112 partially, or completely, surrounds the user's ear. It is contemplated, but not required, that headband hinge 116 can facilitate rotation of the ear cup 102 relative to the user's head 106, which can provide increased comfort and fit compared to non-rotational ear cup assembly 102, particularly when relatively large spring forces are provided by the headband 108 towards the user's head 106.

Figure 2A:
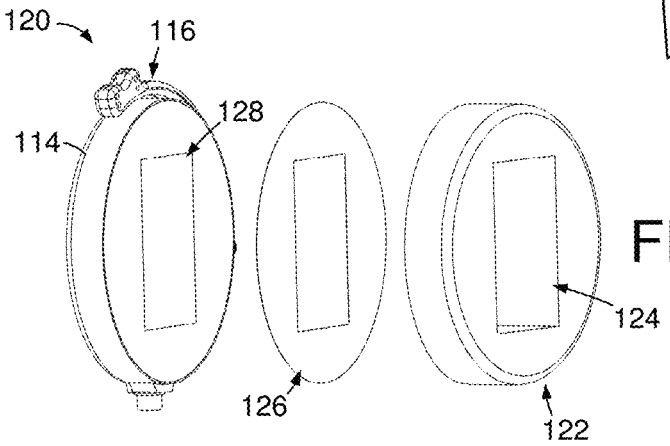
FIGS. 2A and 2B respectively depict portions of an example ear cup that can be utilized in a headphone system in accordance with various embodiments.
Figure 2B:
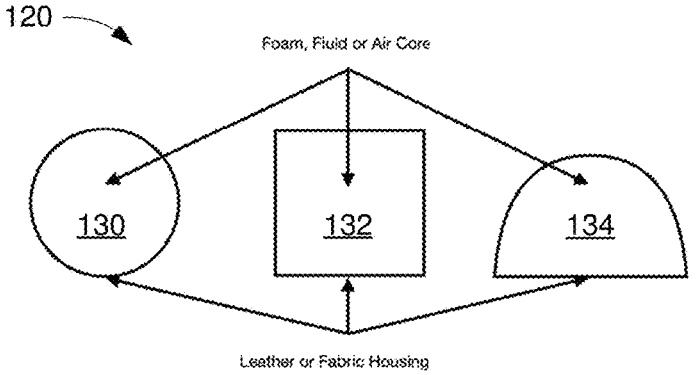

Despite the presence of hinged headbands 108 and ear pads 112 made of pliable materials that increase comfort, the sound quality and acoustic capabilities of the constituent audio driver(s) of the housing 114 can suffer due to the acoustic limitations of previously existing ear pad geometry and materials. FIGS. 2A and 2B respectively convey portions of an example ear cup 120 that can be utilized in a headphone system in accordance with various embodiments. FIG. 2A depicts a line representation exploded view of the ear cup assembly 120 with a housing 114 physically attached to a headband gimbal 116 that allows for at least one or two axes of rotation for the assembly 120 relative to the head of a user. An ear pad 122 can be permanently, or temporarily, connected to the ear cup housing 114 with one or more fastening means, such as adhesive, hook-and-loop, snaps, magnets, friction fit, and keyed engagements.

Regardless of the manner in which the ear pad 122 attaches to the headphone housing 114, one or more acoustic ports 124 can continuously extend through the ear pad 122 and direct acoustic signals from driver(s) in the housing 114 to the user's ear. In some embodiments, one or more acoustic filters 126 are positioned between the ear pad 122 and the driver(s) of the housing 114, which can provide customized acoustic profiles and performance.

It is noted that the size, shape, and material of the ear pad 122 is limited by the ability to cut or mold the foam core that gives the pad structure, but can be formed to a variety of different configurations. FIG. 2B illustrates a non-limiting variety of cross-sectional views of an ear pad that can be attached to the housing 114 as part of a headphone system. A first ear pad 130 has a pliable material, such as foam, rubber, pressurized air, gel, or fluid, constructed with a circular shape and is optionally covered in one or more comfort, or style, textiles, such as leather, suede, synthetic leather, or woven fabric. A square cross-sectional material shape is shown in the ear pad 132 cross-section of FIG. 2B while a semi-circular material shape is provided in the cross-section of the third ear pad 134. The ability to configure an ear pad with a uniform, or multiple different, pliable core shapes when surrounding a user's ear, combined with the ability to customize the comfort material covering the core, allows an ear pad to provide physical comfort for a user over time using a diversity of materials, but always constrained by the potential forms with which these materials may be fabricated.

The fact that an ear pad form is characteristically defined by the fabrication methods available to produce a pliable core, such as foam material, which is either be molded or cut from slabs, or gel or air forced into a sealed and shaped container, places constraints on possible geometry. As geometry can be central to both sound quality and physical fit, this places constraints on headphone designers and limits options for creating a more comfortable experience, or precision tuning the acoustic effects of the ear pad.

Repeatability and tolerances can also be a consideration in conventional ear pad design, particularly when stitching is involved tolerances can be typically be +/−2 mm, or worse. Additionally, pliable materials, such as foam, can exhibit a wide range of durometer values between pieces and lots, which results in ear pads introducing a large tolerance to the finished acoustic response and also to fit and comfort.

Although physical comfort can be important, the acoustic performance of a headphone system, as a whole, is often considered a more critical consideration. That is, ear pads that provide greater acoustic performance due to the absorptive nature of the core and fabrics in use, as well as the geometry of the audio pathway 124. In addition, the fit and seal around a user's ear can greatly impact the final sound of a headphone. For instance, a poor fit often allows ambient noise to intrude on the listener, and in many cases, produces a "leaky" interface between the ear pad 112 and the listener 102 that reduces low frequency output. In some instances, ear pads are designed for physical comfort, or fashion, without regard for acoustic performance. Hence, assorted embodiments of an ear pad provide a customized ear pad that provides a combination of optimized physical comfort and acoustic performance, while other embodiments consider a molded or cast part made of bio-safe, flexible materials, all of which eliminate the requirement for the aforementioned foam, air, or gel core materials.

Figure 3:
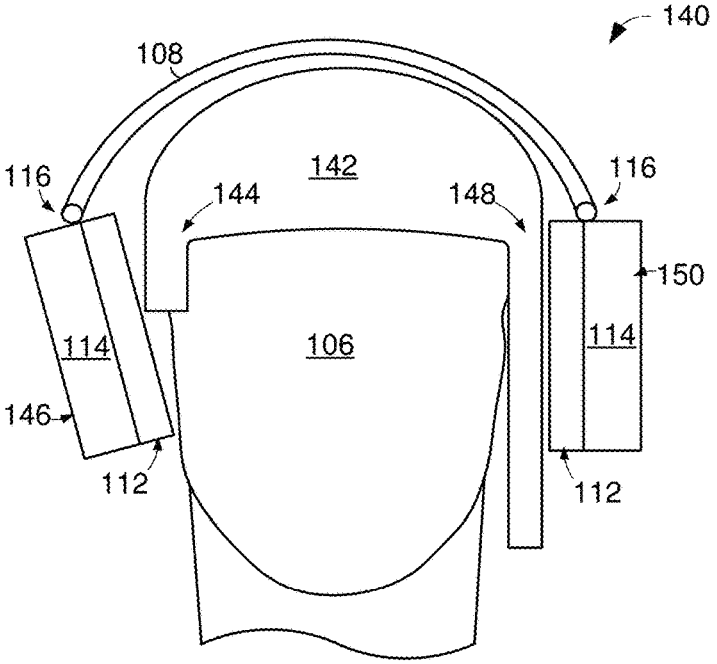
FIG. 3 depicts a line representation of portions of an example headphone system 140 operated in accordance with some embodiments.

FIG. 3 depicts a line representation of portions of an example headphone system 140 exhibiting poor physical fit that contributes to sub-optimal acoustic performance. While not limiting, a user's hair 142 and hair style can play a part in how a headphone ear cup physically contacts the user's head 106 and how the driver(s) of the housing 114 are acoustically coupled to the user's ear. As shown, a first hair style 144 can interact with a first ear cup assembly 146 to incorrectly position the housing 114 and ear pad 112 relative to the user's head/ear to provide optimal acoustic coupling and audio performance. It is noted that an optimal ear pad 112 position relative to a user's ear consists of a substantially parallel position with circumaural contact with the ear pad 112 acoustically sealing the interface of the ear pad to a user's head for a range of acoustic frequencies, such as 20-20 kHz.

While some hair styles can incorrectly orient an ear cup 146, particularly when one or more headband hinges 116 are employed, other hair styles 148 can provide proper ear cup orientation relative to the user's head 106, but prevent proper acoustic sealing, as conveyed with the second ear cup 150. As illustrated, positioning excessively thick or styled hair between the ear pad 112 and the user's head 106 can physically separate some, or all, of the ear pad 112 from the user's ear and/or head, which prevents proper acoustic sealing. The position of hair can be manually manipulated to allow the ear cup 150 to physically engage the user's head, but it is noted that the size of the ear pad 112 overlaps with hair such that it often prevents complete removal of hair from between the user's head 106 and the ear pad 112. Other elements, such as jewelry or glasses, may also be positioned between the ear pad 112 and the head 106 in such a way as to break the seal between the pad 112 and the head 106. Regardless of causality, when air gaps exist between the pad 112 and head 106, a severe loss of low-frequency (bass) musical information frequently occurs.

Accordingly, embodiments of an ear pad provide customized shapes that optimize physical fit and comfort along with acoustic coupling and performance.

By creating custom ear pads using three-dimensional (3D) printing technology, customized and/or personalized ear pad geometries can be created, while molding pads without the constraints of classic "core" materials can produce pads that are smaller, less bulky, and provide unique fitment solutions not possible with pads based on classic core materials. 3D printed ear pads as well as generic molded ear pads fabricated using flexible bio-safe silicone or polymer materials to achieve unusual geometries for both fitment and acoustic tuning purposes. Fully-custom ear pads allow the user to obtain the most comfortable possible fit, as well as increased isolation from external noise sources because they will offer a better, more precise fit than universal-fit ear pads.

As a result, a user experiences optimized comfort along with greater potential for superior isolation from external noise. In addition, the bass of many headphones depends upon establishing a good seal around the ear, which contrasts a poor seal resulting in reduced bass output. It can be appreciated that a non-optimized ear pad can be particularly problematic for people with large or small heads, as well as those with very thick or very curly hair, which can make it virtually impossible to create a seal with conventional, universal-fit ear pads. Generic or custom printed or molded ear pads 112 can provide dramatic and utterly unique style and fitment options, as well as precisely tailored acoustic signatures while eliminating the bulk and acoustic and comfort variances common to conventional ear pad cores.

FIGS. 4A-4D respectively depict cross-sectional view line representations of various configurations of an example ear pad 160 that can be employed in the headphones of FIGS. 1-3. The assorted ear pads 160 may be 3D printed or injection molded. In other words, the ear pads 160 may be molded ear pads with a universal fit to accommodate most people with optimized comfort and acoustic performance by either injection molding or 3D printing the pad using appropriately bio-safe, flexible materials, or an ear pad 160 can be customized with a customized mold, or directly 3D printed using a 3D scan to create a totally personal and optimal fit for superior comfort, style, and acoustic performance.

Figure 4A:
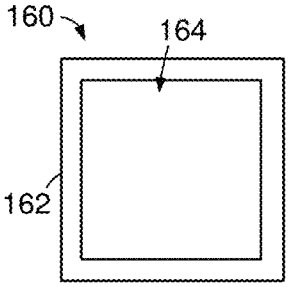
FIGS. 4A-4D respectively convey cross-sectional views of example ear pads arranged in accordance with various embodiments.
Figure 4C:
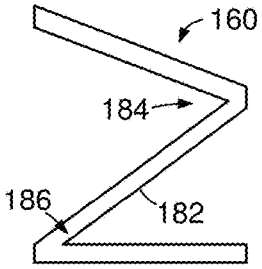
Figure 4B:
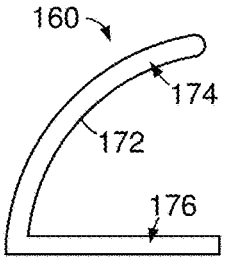

It is noted that the use of printed or molded ear pads can eliminate the need to use foam to create a core structure and, in fact, creates the potential to create super-thin single-wall ear pads, as shown in the non-limiting examples of FIGS. 4B and 4C. Additionally, molded ear pads allow a wide range of novel ear pad geometries to be realized. FIG. 4A depicts a hollow box ear pad 160 configuration that can be created with a mold and/or 3D printed. The ear pad 160 has a unitary sidewall 162 that defines an interior cavity 164 that can be sealed, or open, to outside air. It is contemplated that, unlike conventional foam-core pads, the interior cavity 164 is filled with non-pressurized air, or even that one exterior, or interior, sidewall could be eliminated, creating a single-walled pad with a cross-section shown in FIG. 5A. Optionally, a gel, fluid, or other damping material can be used to fill the void 164 and increase comfort and the acoustic sealing of the ear pad 160. It is noted that a unitary sidewall 162 has no seams, joints, or other attachments and is a single piece of material, even though it may be printed or molded.

By using a pliable material for the unitary sidewall 162, such as silicone, the ear pad 160 may be made much thinner than conventional foam, air, or gel-core parts, which allows for smaller pad sizes, reduced weight and bulk, yet due to the material properties of silicone, butyl, or other similarly dense, but flexible, materials, the thinner pad may actually offer potentially superior isolation from noise. The ability to fine-tune ear pad geometry allows the ability to optimize acoustic response properties and provide solutions to address fitment for different types of hair, hair styles, or skull shape of users. Indeed, the potential geometries and styles of various embodiments to fit the user are unlimited.

FIG. 4B depicts an example open ear pad 160 configuration where a unitary sidewall 172 defines a continuously curvilinear portion 174 shaped to enclose the listener's ear and a, non-limiting, continuously linear portion 176 which serves as the mount point to the headphone, noting that other mounting options are possible. The curvilinear portion 174 may, in some embodiments, have a thickness and shape that provide a predetermined spring force, or resistance to force, when contacting a user's head, which compresses to provide dynamic ear pad 160 operation that maintains an optimized acoustic seal despite physical movements and/or pressures of the ear pad 160. The unitary sidewall 172 can provide increased strength and rigidity compared to ear pad configurations that fasten two or more materials together. Further, by tapering the material around portion 174, a "crumple zone" can be created that allows controlled deformation of the pad 160 when a headphone is seated on a listener's head.

In FIG. 4C, an example ear pad 160 has a unitary sidewall 182 that defines a spring-type shape with a first bend 184 and an opposite-facing second bend 186. The unitary sidewall 182 can be arranged in an unlimited variety of thicknesses, lengths, and angular positions to provide a predetermined amount of rigidity, strength, and pliability while retaining an optimized acoustic seal on a user's ear. While a completely linear configuration is shown in FIG. 4C, it is contemplated that the respective bends 184/186 are curvilinear, which can alter the physical characteristics of how the ear pad 160 seals to the user's head.

Figure 4D:
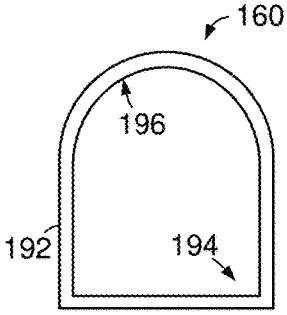

FIG. 4D depicts an alternative ear pad 160 that utilizes a closed configuration with a unitary sidewall 192 that defines an interior cavity 194 with a combination of linear and curvilinear portions. In contrast to the "box" design of FIG. 4A, the ear pad 160 of FIG. 4D positions the curvilinear portion of the unitary sidewall 192 proximal the user's ear, which provides a more pliable region in contact with the user's head. The shape of the curvilinear portion, and the ability to optimize the filling of the interior cavity 194, allows the ear pad 160 to be altered to provide a wide range of physical properties that can optimize diverse user head shapes, hair styles, and comfort preferences. As shown in FIGS. 4A & 4D, one exterior wall can be open, which eliminates any internal volume of air. It is contemplated that the exterior wall openings can be selectively closed with one or more plugs that allows a user to alter the structural, and acoustic, properties of the pad 160.

Through the customization of ear pads with one or more cross-sectional shapes, such as convex, concave, traditional box, or even "spring" like designs, a molded, or 3D printed, ear pad can achieve a virtually unlimited range of ear pad configurations. It is noted that FIGS. 4A, 4B and 4C show non-limiting examples of very different ear pad 160 configurations that can be molded or 3D printed, several of which would be difficult or impossible to produce using conventional ear pad materials and fabrication processes.

The unitary sidewall 162, 174, 186, and 196 shown in FIG. 4 may be a uniform thickness throughout, or have a variable thickness, or taper, to achieve specific geometries, and fitments, through controlled compression/deformation when the headphone is worn.

The ability to mold or print customized cross-sectional ear pad shapes and configurations allows for an ear pad to be rather sophisticated compared to conventional ear pads that utilize a pliable core covered in a textile. FIGS. 5A-7B respectively convey non-limiting cross-sectional and perspective line representations of different generic ear pads that can be created with 3D printing and cannot, practically, be fabricated with conventional pliable cores covered in a fabric or textile.

Figure 5A:
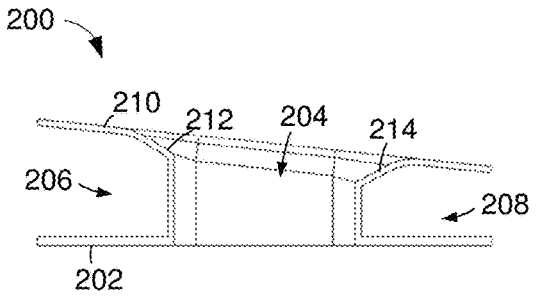
FIGS. 5A-5C respectively depict views of an example ear pad that may be utilized in accordance with assorted embodiments.
Figure 5B:
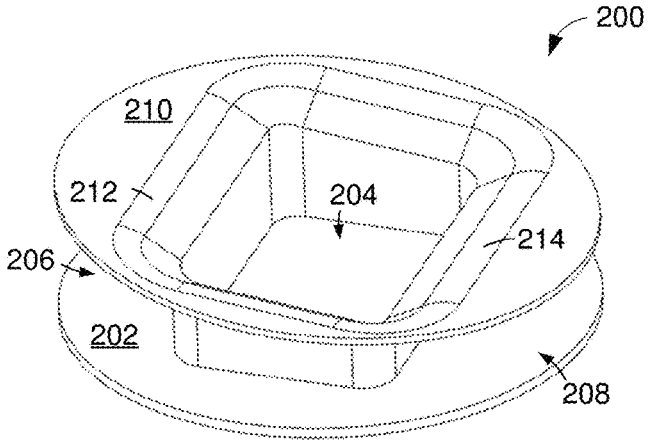

FIGS. 5A and 5B show an example generic molded, or 3D printed, ear pad 200 constructed with a unitary sidewall 202 that provides a unique "maximum volume around the ear" cross-sectional configuration. The cross-sectional view of FIG. 5A conveys how a central sound aperture 204 is defined by the unitary sidewall 202 that provides differently arranged open cavities 206 and 208 to accommodate head shape and/or hair styles to provide optimal fit, comfort, and acoustic performance.

As illustrated in FIG. 5A, the single, continuous, and unitary sidewall 202 extends from a planar bottom surface to a planar top surface 210. Although not required or limiting, the shape and size of the sound aperture 204 can be tailored to optimize the delivery of acoustic signals to the user's ear. For example, a beveled aperture exit can be formed with linear, or curvilinear, sidewalls 212 and 214 that respectively define the open cavities 206 and 208 while the shape, width, height, and material choice determine how sound travels and is delivered to the user's ear fitted within the sound aperture 204, as conveyed by the perspective view of FIG. 5B.

Figure 5C:
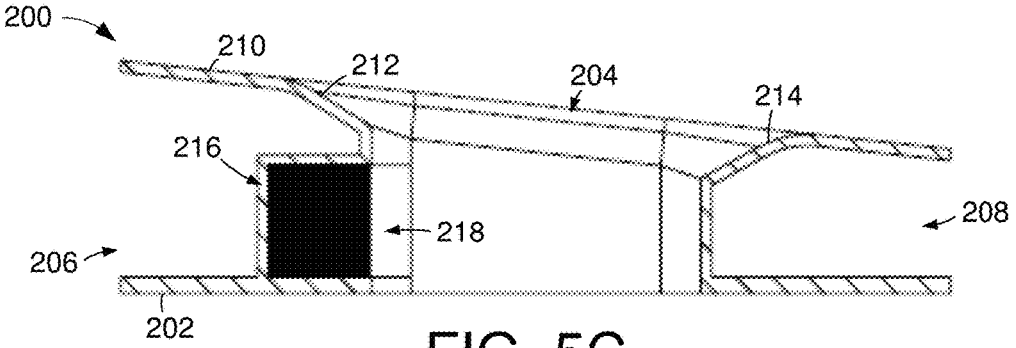

FIG. 5C shows a non-limiting example of how the open cavity 206 can be configured with a recess 216 that holds acoustic tuning materials, such as wool, felt, foam, or other acoustic materials with the ability to absorb, or diffuse, audio waves. The recess 216 may be any shape, size, or position, as determined by industrial design, mechanical, and/or acoustic considerations. It is contemplated that the recess 216 is exposed to the sound aperture 204 via a completely open aperture 218, a perforated wall, or acoustically permeable fabric.

Figure 6A:
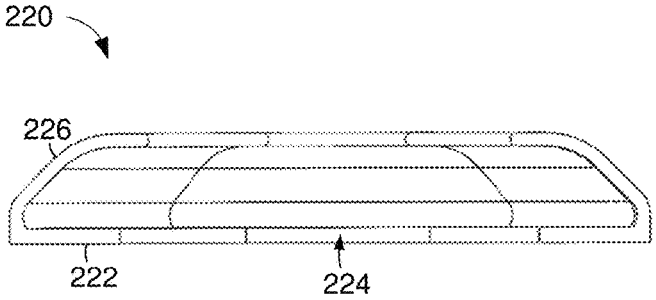
FIGS. 6A and 6B respectively depict views of an example ear pad that can be carried out in accordance with some embodiments.
Figure 6B:
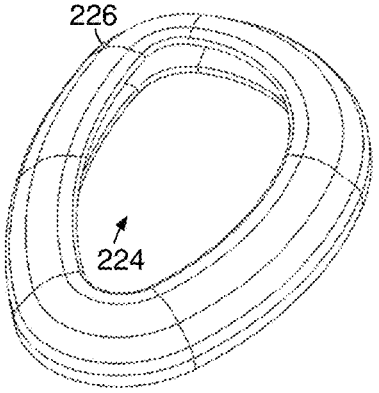

FIGS. 6A and 6B depict an alternative, non-limiting ear pad 220 with a symmetrical concave cross-sectional shape that can provide different acoustic and fitment than the ear pad 200 of FIGS. 5A-5C. A unitary sidewall 222 of the ear pad 220 is configured to define an internal cavity 224 that is open to a sound aperture that couples to a user's ear, as illustrated in FIG. 6A. The unitary sidewall 222 continuously extends with linear and curvilinear 226 surfaces to provide physical properties, such as rigidity and pliable range, that may be similar to the unitary sidewall shape of FIG. 5B. By comparing the designs of ear pads 200 and 220, it can be seen how radically different molded, or 3D printed, ear pads can be created compared to conventional core material designs.

The perspective view of FIG. 6B illustrates how the internal cavity 224 can surround the ear of a user and provide a pliability and predetermined physical characteristics without a closed, sealed, filled, or solid core. The open cavity 224 configuration of FIGS. 6A and 6B may be characterized as a concave sidewall 222 shape that provides different fit, comfort, and acoustic coupling capabilities. In this instance, the exterior sidewalls define concave volumes such that the inner walls 212 and 214 are close to the ear while a flange surface 210 provides a seal outside the volume of the cavity 204. By way of a real world example, ear pad 220 has the smallest contact area and, in fact, can be placed proximal to or "under" the listern's pinna, where there is typically no hair, which facilitates a quality seal in contrast to a conventional ear pad that would have to "float" on hair.

With the configuration of ear pad 200, users with very thick hair can be accommodated. That is, surface 210 extends outwards from the sound aperture 204, which contrasts the concave surface 226 of ear pad 220. In the case of the concave surface 226 of ear pad 220, the pad's contact surface is proximal to the point where the ear attaches to the user's head, which is normally free of hair. Meanwhile, surface 210 of ear pad 200 places the contact surface on the hair of the user and further from the ear. As such, surface 226 is far more likely to create an effective seal around the ear for people with thick, or curly, hair than surface 210.

Figure 7A:
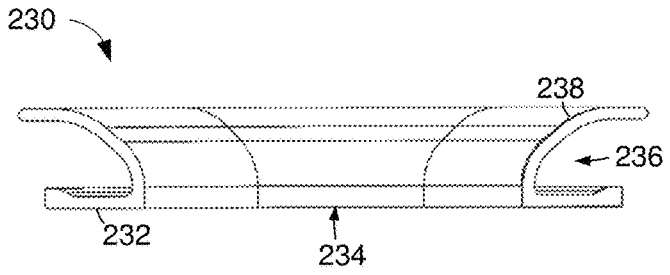
FIGS. 7A and 7B respectively depict views of an example ear pad that is executed in accordance with various embodiments.
Figure 7B:
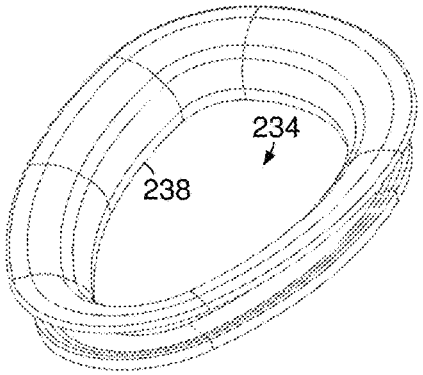

FIGS. 7A and 7B depicts views of an ear pad 230 with a unitary sidewall 232 that has a convex shape defining a sound aperture 234 as well as external open cavities 236. The ability to create convex or concave unitary sidewall shapes can accommodate different head and ear shapes as well as varying hair styles, textures, and densities to establish and maintain an stable acoustic coupling the corresponds with optimal acoustic performance.

Figure 8A:
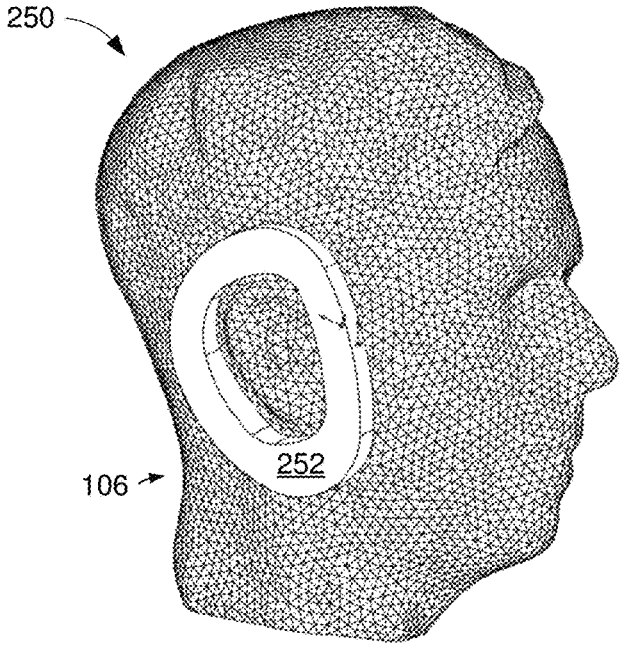
FIGS. 8A and 8B respectively depict views of an example views of aspects of an example ear pad system employed in accordance with assorted embodiments.
Figure 8B:
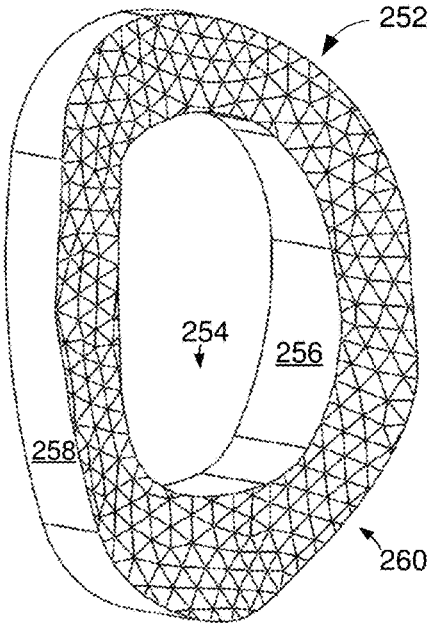

The customization of the shape, size, and configuration of an ear pad, either with 3D printing or 3D printed molding techniques, can provide robust tuning capabilities for a user to customize the fit, comfort, and acoustic profile while wearing over-ear headphones. Some embodiments can further tune an ear pad by contouring the ear pad surface that contacts the user's head. FIGS. 8A and 8B respectively depict perspective views of aspects of an example ear pad system 250 undertaken in accordance with some embodiments. FIG. 8A shows how a template 252 can be fit to a user's head 106 to create an impression of the topography of the user's skin around the user's ear.

The template 252 is shown as a continuous ring with a non-limiting "box" cross-sectional shape, as shown in FIG. 4A, but such configuration is not required as the template 252 may be any shape, size, and material to accurately record the topography of the user's head in a physical medium. That is, the physically pressed template contrasts a digital mapping of the user's head with one or more 3D mapping sensors by providing a tangible medium with which at least one customized ear pad surface can be created by mapping the scanned surface area to the printable surface 260. Yet, it is contemplated that a physical template 252 may be utilized in conjunction with optical sensing of a 3D scanner and a resulting digital map of the user's head/ear to provide an optimal ear pad sealing surface configuration.

FIG. 8B depicts how the template 252 has an internal ear aperture 254 defined by an internal sidewall 256 while an external sidewall 258 defines the perimeter of a sealing surface 260 that matches the topography of the user's head proximal to the ear. The physical material of the template 252 may be printable or moldable substances for accurate creation of an ear pad surface contoured as an exact match to the user's skull to comfortably provide an optimized acoustic seal with uniform pressure on all surfaces when contacting the user's head. It is contemplated that the customized surface of an ear pad can be contoured based on a 3D scan of a user's head to provide a totally custom fitment when utilized in combination with the physical template 252.

Figure 9:
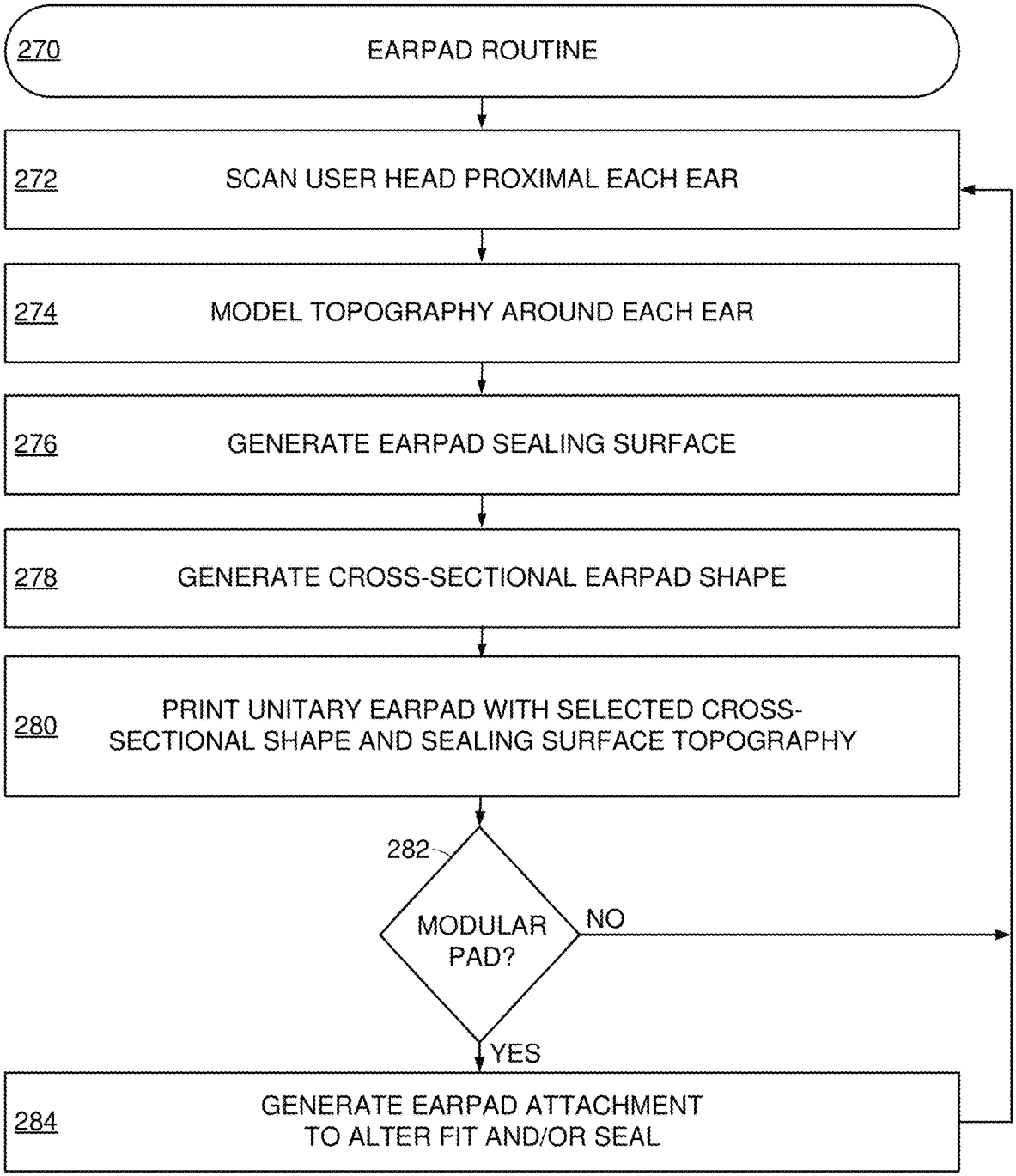
FIG. 9 conveys an example ear pad routine that can be utilized to create and employ various embodiments of a headphone ear pad system.

FIG. 9 is an ear pad routine 270 that can be executed to produce and use a customized ear pad for a headphone. Initially, portions of a user's head can be optically scanned in step 272. The digital representation of the user's head can be efficiently transmitted to a manufacturing site, or device where an ear pad can be created. It is noted that step 272 may involve a physical template, as shown in FIGS. 8A and 8B, that is pressed to capture the topography of the user's head and that physical template is scanned and transmitted to an ear pad manufacturer.

The topography of the user's head proximal each ear is used in step 274 to model a sealing topography to create an optimal acoustic coupling. The sealing topography created in step 274 may be different than the actual topography of the user's head, in some embodiments, to avoid unwanted vacuum creation, sweating, occlusion, embedding a channel for eyeglasses, or increase airflow. With the sealing topography from step 274, an ear pad sealing surface is generated in step 276. Such ear pad sealing surface can be configured for the type of ear pad being utilized, such as a sealed or open ear pad. The sealing surface 260 may also be covered by an appropriate fabric to enhance comfort The optimization and customization of the sealing surface of an ear pad is complemented by a cross-sectional shape optimized for the user's head and hair to provide dynamic comfort and a reliable acoustic coupling. Step 278 generates such an optimized model and mesh for printing the part, or generating a mold, and step 280 subsequently creates a single-piece ear pad consisting of a unitary, or dual, sidewall defining a sound aperture and a sealing surface customized for the user's head and/or hair. The constructed ear pad can then be attached to a headphone housing to allow engagement of the ear cup assembly with the user's head to reproduce sound with predetermined, optimized and customized properties.

While routine 270 may end with step 280, some embodiments can augment an ear pad with one or more modular attachments. Decision 282 evaluates if an attachment is called for, such as the non-limiting example of using a preformed generic "base" pad and attaching the custom surface produced in step 280 to make a hybrid generic/custom ear pad. If so, step 284 generates at least one ear pad attachment that can attach to an ear pad to alter the ear pad's physical and/or acoustic properties. For instance, a modular ear pad attachment may physically separate the ear pad sealing surface from the user's head, alter the sound aperture of the ear pad, or accommodate the placement of hair, or jewelry, through the ear pad. The ability to customize the ear pad after construction and use, via one or more modular attachments, allows a headphone system to be continually optimized despite changing goals and purposes of the user.

As an alternate method, a custom ear pad can be created via 3D printing or from 3D printed molds as follows:

1) Create a 3D data set corresponding to the user's head using an appropriate app on a professional 3D scanner, or a personal communications or communications device such as a tablet or phone using a 3D scanning app.
2) Transmittal of data to the manufacturer for processing, via any method such as but not limited to email, thumb drives, download to websites, etc.
3) Processing the user data in an appropriate software application to produce a printable ear pad model.
4) Printing the actual pad on an appropriate printing device loaded with bio-safe material.
5) Finishing the pads with a bio-safe fabric or spray-coating to provide a luxurious and comfortable finish.

Creating generic or custom injection molded ear pads using silicone or polymers is not as flexible as printing ear pads, but it offers the following potential benefits relative to traditionally fabricated, core-based ear pads:

1) Significant design flexibility using the novel cross sections and designs impossible to produce with solid-core pads.
2) Less bulky ear pads are made possible by replacing bulky foam cores with simple molded structures.
3) Performance is improved by reducing energy lost as acoustic energy is absorbed by the flexible fabrics and foams used in conventional ear pads, particularly at lower frequencies.
4) Longer ear-pad life, as foam typically degrades with time and use while non-limiting materials like silicone or flexible polymers can offer a longer effective service life.
5) New design and style options facilitated by entirely new convex and concave ear pad designs such as the non-limiting examples of FIGS. 5, 6, and 7.
6) It is possible to mold ear pads that create optimized seal and improved comfort for listeners using more complex geometries than can be achieved through foam-core and fabric ear pads.

Foam or other acoustically absorptive material may be integrated as needed into molded or printed ear pads for comfort or acoustic tuning purposes. As a non-limiting example, creating a printed or molded ear-cavity wall with "fenestrated" (perforated) surface and a foam backing on the opposite side of the wall from the listener's ear can be used to acoustically fine-tune the headphone

What is claimed is:

1. A method comprising:

using a three-dimensional data set of an ear of a user to create a custom ear pad with a unitary sidewall continuously extending to define a sound aperture and an annular cavity, the unitary sidewall having a uniform thickness throughout the custom ear pad;

attaching the custom ear pad to a headphone housing; and forming an acoustic coupling to interface with an ear of the user and an acoustic driver of the headphone housing via the custom ear pad.

2. A method comprising forming a unitary ear pad with a one-piece sidewall continuously extending to define a sound aperture and an annular cavity, the one-piece sidewall having a uniform thickness throughout the unitary ear pad;

attaching the ear pad to a headphone; and positioning the unitary ear pad over the ear of a user to create an acoustic seal with the head of the user.

3. The method of claim 2, wherein the unitary ear pad is formed by injection molding.

4. The method of claim 2, wherein the unitary ear pad is formed by 3D printing.

5. The method of claim 2, further comprising using a three-dimensional data set of the user to create a custom shape for the unitary ear pad.

6. An apparatus comprising an ear pad attached to a headphone housing, the ear pad acoustically coupling an acoustic driver positioned in the headphone housing to an ear of a user, the ear pad comprising a unitary sidewall continuously extending to define a sound aperture and an annular cavity.

7. The apparatus of claim 6, wherein the sound aperture is aligned with an ear drum of the ear of the user.

8. The apparatus of claim 6, wherein the ear pad continuously surrounds the ear of the user.

9. The apparatus of claim 6, wherein the unitary sidewall has a uniform thickness.

10. The apparatus of claim 6, wherein the unitary sidewall applies a predetermined spring force uniformly about ear of the user.

11. The apparatus of claim 6, wherein the ear pad is symmetrical about the sound aperture.

12. The apparatus of claim 6, wherein the unitary sidewall defines a concave shape that positions the annular cavity proximal the sound aperture.

13. The apparatus of claim 6, wherein the unitary sidewall extends from the sound aperture to define a top surface and a bottom surface, the top surface separated from the bottom surface by the annular cavity and the sound aperture.

14. The apparatus of claim 13, wherein the top surface is linear and oriented at a non-normal angle with respect to the bottom surface.

15. The apparatus of claim 13, wherein the bottom surface extends to a greater width than the top surface, the width measured as a distance from the sound aperture.

16. The apparatus of claim 13, wherein top surface contacts a skin of the user under a pinna portion of the ear of the user to position portions of the ear of the user in the annular cavity.

17. The apparatus of claim 6, wherein the unitary sidewall defines a recess acoustically coupled to the sound aperture.

18. The apparatus of claim 17, wherein the recess is separated from the annular cavity.

19. The apparatus of claim 17, wherein the recess is filled with acoustically permeable fabric.

20. The apparatus of claim 17, wherein the recess comprises a perforated wall.

* * * * *